US011689866B2

(12) United States Patent
Cherigui

(10) Patent No.: US 11,689,866 B2
(45) Date of Patent: Jun. 27, 2023

(54) HEARING DEVICE ADAPTED TO PERFORM A SELF-TEST AND A METHOD FOR TESTING A HEARING DEVICE

(71) Applicant: Sonova AG, Stafa (CH)

(72) Inventor: Fethi Cherigui, Adliswil (CH)

(73) Assignee: SONOVA AG, Stäfa (CH)

( * ) Notice: Subject to any disclaimer, the term of this patent is extended or adjusted under 35 U.S.C. 154(b) by 0 days.

(21) Appl. No.: 16/643,174

(22) PCT Filed: Aug. 31, 2017

(86) PCT No.: PCT/EP2017/071908
§ 371 (c)(1),
(2) Date: Feb. 28, 2020

(87) PCT Pub. No.: WO2019/042557
PCT Pub. Date: Mar. 7, 2019

(65) Prior Publication Data
US 2020/0260194 A1 Aug. 13, 2020

(51) Int. Cl.
*H04R 25/00* (2006.01)

(52) U.S. Cl.
CPC ..... *H04R 25/305* (2013.01); *H04R 25/505* (2013.01); *H04R 25/558* (2013.01); *H04R 25/604* (2013.01); *H04R 25/609* (2019.05); *H04R 2225/55* (2013.01); *H04R 2460/15* (2013.01)

(58) Field of Classification Search
CPC . H04R 25/305; H04R 25/609; H04R 2225/61
USPC ..... 381/60
See application file for complete search history.

(56) References Cited

U.S. PATENT DOCUMENTS 5,014,316 A * 5/1991 Marrah ..... H04H 20/49 329/304
5,815,581 A * 9/1998 Andersson ..... H03F 3/2173 330/251

(Continued)

FOREIGN PATENT DOCUMENTS

EP 2 039 216 B1 3/2009
GB 2547490 A 8/2017

OTHER PUBLICATIONS

International Search Report for PCT/EP2017/071908 dated May 28, 2018.

(Continued)

*Primary Examiner* — Katherine A Faley
(74) *Attorney, Agent, or Firm* — Pearne & Gordon LLP

(57) ABSTRACT

Hearing devices capable of performing a self-test as well as a method for automatically testing a hearing device. A hearing device includes a measurement bridge circuit connected to the receiver of the hearing device in parallel with the audio amplifier of the hearing device. A method for self-testing a hearing device includes the steps of i) disabling the audio amplifier connected to the receiver, in particular by putting the amplifier in a high impedance state, ii) applying with a measurement bridge circuit a direct current (DC) and/or an alternating current (AC) to the receiver, iii) measuring with the measurement bridge circuit (5) a voltage at the receiver, and iv) detecting a presence or absence of a fault condition based on the measured voltage.

21 Claims, 1 Drawing Sheet

(56) References Cited

U.S. PATENT DOCUMENTS

| | | | | |
|---|---|---|---|---|
| 2007/0286441 | A1* | 12/2007 | Harsch | H04R 25/30 381/315 |
| 2011/0116643 | A1 | 5/2011 | Tiscareno et al. | |
| 2013/0322669 | A1* | 12/2013 | Boretzki | H04R 25/70 381/314 |
| 2014/0363014 | A1* | 12/2014 | Liu | H04R 1/1041 381/74 |
| 2015/0230018 | A1 | 8/2015 | Wen et al. | |
| 2017/0223467 | A1 | 8/2017 | Jensen et al. | |

OTHER PUBLICATIONS

Written Opinion for PCT/EP2017/071908 dated May 28, 2018.
John Ardizzoni, "Is Your Amplifier Disabled, or is it Merely Sleeping?", Analog Dialogue, Jul. 2010, issue #59.

* cited by examiner

HEARING DEVICE ADAPTED TO PERFORM A SELF-TEST AND A METHOD FOR TESTING A HEARING DEVICE

TECHNICAL FIELD

The present invention pertains to hearing devices capable of performing a self-test as well as to a method for automatically testing a hearing device. This is especially important in conjunction with self-fitting and remote fitting of a hearing device as well as more generally providing remote support, i.e. in situations where no hearing device specialist, such as an audiologist, is present to test the hearing device locally before adjusting the hearing device settings to the needs and preferences of the user or to consult the user when experiencing problems with the hearing device.

BACKGROUND OF THE INVENTION

In the context of the present invention the term "hearing device" refers to hearing aids (alternatively called hearing instruments or hearing prostheses) used to compensate hearing impairments of hard of hearing persons, as well as to audio and communication devices used to provide sound signals to persons with normal hearing capability, e.g. in order to improve hearing in harsh acoustic surroundings, and also to hearing protection devices employed to prevent damaging of the sense of hearing of a person when exposed to very loud noises such as gunshots. Such hearing devices are typically worn at or at least party within the ear, e.g. within the ear canal of the user.

Typically, hearing device settings, such as audio processing settings, need to be adjusted to the individual needs and preferences of a user, e.g. to compensate the specific hearing loss of the user. This process is commonly referred to as hearing device "fitting" and is usually performed by a hearing device specialist such as an audiologist, then often referred to as a hearing device "fitter".

To avoid having to visit the fitter for instance to improve previous settings it is becoming increasingly popular to perform "remote fitting" or for the fitter to provide "remote support", e.g. by allowing the fitter to adjust hearing device settings via a communication network to which the hearing device can be connected for instance with the aid of a smartphone. Alternatively, it has also become commonplace for the user himself to adjust the hearing device settings, a process referred to as "self-fitting".

It is important to ensure that the hearing device is working properly (i.e. not malfunctioning) and being worn correctly by the user before commencing with remote fitting or self-fitting. This requires that the hearing device itself is capable of determining whether it is operating correctly or not, which can be achieved by means of an automatic "self-test". Likewise, the outcome of such a self-test is instrumental for any kind of remote support, where the audiologist does not have direct access to the hearing device.

Hence, with the proliferation of hearing device self-fitting and remote fitting as well as generally providing remote support for hearing device users there in an increased need for effective and reliable automatic self-test/-diagnosing schemes.

SUMMARY OF THE INVENTION

It is an object of the present invention to provide a hearing device with a built-in automatic self-test mechanism. This object is achieved by the hearing device according to claim 1.

It is a further object of the present invention to provide a method for automatically self-testing a hearing device. Such a method is specified in claim 13.

Specific embodiments of the present invention are provided in the dependent claims.

In a first aspect, the present invention is directed to a hearing device, comprising:

- an input transducer;
- a signal processor;
- an audio amplifier, in particular a class D amplifier with an H-bridge;
- a receiver, wherein the input transducer is connected to the signal processor, the signal processor is connected to the amplifier, and the amplifier is connected to the receiver, characterised in that the hearing device further comprises a measurement bridge circuit connected to the receiver in parallel with the amplifier.

In an embodiment of the hearing device the measurement bridge circuit is adapted to controllably supply a direct current (DC) or an alternating current (AC) to the receiver and to measure a voltage at the receiver.

In a further embodiment of the hearing device the direct current (DC) or the alternating current (AC) is provided by a respective current steering digital-to-analogue converter (DAC).

In a further embodiment of the hearing device the measurement bridge circuit, more particularly the respective current steering digital-to-analogue converter (DAC), is controllable by an output of the signal processor, or more particularly by an output of an audio delta-sigma(-type digital-to-analogue) converter.

In a further embodiment of the hearing device a first current steering digital-to-analogue converter (DAC) is controlled by a first output of the signal processor, or more particularly by a first code output by an audio delta-sigma (-type digital-to-analogue) converter to provide the direct current (DC), and wherein a second current steering digital-to-analogue converter (DAC) is controlled by a second output of the signal processor, or more particularly by a second code output by the audio delta-sigma(-type digital-to-analogue) converter to provide the alternating current (AC).

In a further embodiment the hearing device is operable in a normal mode and in a measurement (or test) mode, wherein in the normal mode the amplifier is enabled and provides an amplified output signal to the receiver, and wherein in the measurement mode the amplifier is disabled, in particular switched to a high impedance state, and the measurement bridge circuit supplies a direct current (DC) or an alternating current (AC) to the receiver and measures a voltage at the receiver.

In a further embodiment the hearing device is adapted to detect a presence of a fault condition if at least one of the following is determined to be incorrect based on at least one measurement of the voltage at the receiver:

- the receiver is correctly connected to the hearing device;
- the connected receiver is of a certain, desired receiver type;
- the hearing device is correctly placed within an ear canal of a user of the hearing device;
- the receiver is not obstructed, in particular a sound outlet of the hearing device is not clogged by cerumen/earwax.

In a further embodiment the hearing device further comprises a non-volatile memory storing reference data, wherein the reference data in particular pertain to one or more peaks of an impedance of the receiver, for instance in terms of a peak's amplitude and frequency, and wherein the one or more peaks are in particular determined by measuring the impedance of the receiver when the hearing device is being properly, in particular sealingly, worn in an ear canal of the user and/or when the hearing device is not being worn, and wherein the one or more peaks are in particular determined during fitting of the hearing device to needs and preferences of the user.

In a further embodiment the hearing device is adapted to detect a presence or absence of a fault condition based at least partly on the reference data, in particular based on a comparison of a quantity related to the at least one measurement of the voltage at the receiver with at least part of the reference data.

In a further embodiment the hearing device is adapted to detect the presence or absence of a fault condition based on one or more of the following:

- a direct current (DC) impedance of the receiver, in particular determined by applying a direct current (DC) to the receiver, as an indication whether the receiver is correctly connected to the hearing device and as an indication whether a certain, desired receiver type is connected to the hearing device, the latter in particular being dependent on a comparison of a quantity related to the at least one measurement of the voltage at the receiver with a predetermined reference value or range representative for the certain, desired receiver type;
- an alternating current (AC) impedance of the receiver, in particular determined by applying an alternating current (AC) to the receiver, as an indication whether the hearing device is correctly placed within the ear canal of the user and as an indication whether the receiver is not obstructed, both in particular being dependent on a comparison of a quantity related to the at least one measurement of the voltage at the receiver with one or more predetermined reference values representative for the hearing device being properly, in particular sealingly, worn in an ear canal of the user and/or for the receiver not being obstructed.

The reference values are determined previously, for example during a fitting session.

In a further embodiment the hearing device is adapted to perform at least one of the following based on the presence or absence of a fault condition:

- provide an optical fault indication signal, for instance by means of a light emitting diode (LED);
- provide an acoustic signal via the receiver, in particular when the absence of a fault condition has been detected;
- disable adjusting of one or more hearing device settings when the presence of a fault condition has been detected;
- disable at least one function of the hearing device when the presence of a fault condition has been detected.

In a further embodiment of the hearing device the measurement bridge circuit comprises a resistor as a minimal load when no receiver is connected to the hearing device or when the receiver is incorrectly connected to the hearing device.

In a second aspect, the present invention is directed to a method for self-testing a hearing device, in particular the hearing device specified above, based on employing a measurement bridge circuit connected to a receiver of the hearing device in parallel with an amplifier of the hearing device, the method comprising the steps of:

- disabling the amplifier, in particular by putting the amplifier in a high impedance state;
- applying with the measurement bridge circuit a direct current (DC) and/or an alternating current (AC) to the receiver;
- measuring with the measurement bridge circuit a voltage at the receiver;
- detecting a presence or absence of a fault condition based on the measured voltage.

In an embodiment of the method the measured voltage is indicative of the direct current (DC) or the alternating current (AC) impedance of the receiver, based upon which the presence of a fault condition is detected if at least one of the following is determined to be incorrect:

- the receiver is correctly connected to the hearing device;
- the connected receiver is of a certain, desired receiver type;
- the hearing device is correctly placed within an ear canal of a user of the hearing device;
- the receiver is not obstructed, in particular a sound outlet of the hearing device is not clogged by cerumen/earwax.

In a further embodiment the method further comprises at least one of the following based upon detecting the presence or absence of a fault condition:

- providing an optical fault indication signal, for instance by means of a light emitting diode (LED);
- providing an acoustic signal via the receiver, in particular when the absence of a fault condition has been detected;
- disabling adjusting of one or more hearing device settings when the presence of a fault condition has been detected;
- disabling at least one function of the hearing device when the presence of a fault condition has been detected.

In a further embodiment of the method a frequency of the alternating current (AC) applied to the receiver is varied, in particular to provide a frequency sweep or a polyphonic signal to the receiver as a test signal.

In a further embodiment of the method detecting the presence or absence of a fault condition is based on determining an impedance of the receiver as a function of a frequency of the alternating current (AC) applied to the receiver and comparing the determined impedance with predetermined reference data.

In a further embodiment the method is started upon each powering-on of the hearing device, in particular the method is started with a time delay after powering-on the hearing device.

In a further embodiment the method is started when initiating fitting of the hearing device to needs and preferences of the user, for instance when initiating a self-fitting session or a remote fitting session.

In a further embodiment the method is started when initiating a remote support session.

In a further embodiment the method is started by the user, for instance by operating a control element at the hearing device or at a hearing device accessory, such as a remote control unit or a mobile phone, in particular a smartphone.

It is pointed out that combinations of the above-mentioned embodiments may give rise to even further, more specific embodiments of the hearing device and method according to the present invention.

BRIEF DESCRIPTION OF THE DRAWINGS

The present invention is further described with reference to the accompanying drawings that pertain to an exemplary embodiment, and which are to be considered in connection with the following detailed description. What is shown in the drawings is.

DETAILED DESCRIPTION OF THE INVENTION

Before fitting a hearing device it needs to be ensured that the hearing device or an otoplastic connected to a hearing device is correctly inserted into the ear canal and sufficiently sealing the ear canal such that no or only very little ambient sound directly reaches the eardrum (i.e. bypasses the hearing device or otoplastic), viz. that the acoustic coupling is in order. Furthermore, it must be ascertained that the correct receiver is being used in the hearing device, e.g. that the desired earphone is connected to the behind-the-ear (BTE) part of a receiver-in-the-canal (RIC) type hearing device (also referred to as canal receiver technology, CRT), and furthermore, it must be guaranteed in this case that the electrical connection between the receiver and the BTE part is intact. Finally, it must be made sure that the receiver and the sound port directed towards the eardrum is not clogged with cerumen, which would otherwise attenuate the sound output by the receiver into the ear canal. All these problems can be detected by measuring the receiver acoustic impedance as a function of frequency when the hearing device is being worn by the user. By measuring the impedance versus frequency the electrical and acoustical condition of the receiver/earphone as well as the acoustic coupling can be evaluated. Thereby, the direct current (DC) impedance helps to determine whether the receiver is of the correct type and whether the receiver is electrically correctly connected (e.g. detect an open connection as well as a short circuit). Each type of receiver/earphone has a specific characteristic frequency response. When a receiver is properly plugged/inserted into the ear canal the acoustical impedance curve (i.e. the alternating current (AC) impedance) will typically exhibit a shift of the resonance peaks towards lower frequencies compared to the case when the hearing device is not being worn. Similarly, when the receiver is clogged and the sound is being obstructed when being output into the ear canal, the resonance peaks are shifted even more towards lower frequencies than when the receiver is not correctly inserted into the ear canal.

Figure 1:
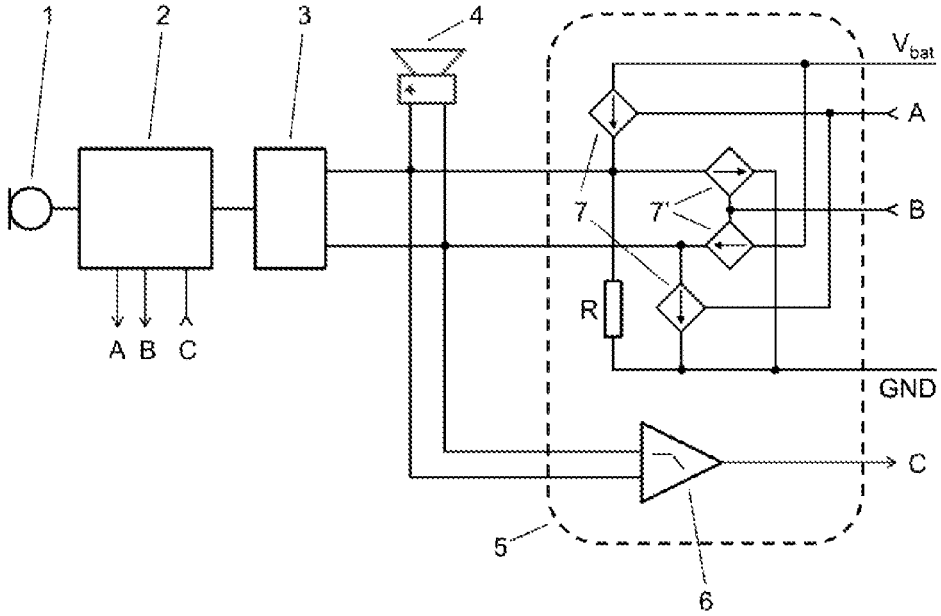
FIG. 1 a high-level schematic diagram of a hearing device with an embodiment of a built-in automatic self-test mechanism according to the present invention.

According to the present invention DC and AC impedance measurement is done using a measurement bridge circuit, parallel to the main H-bridge (audio amplifier). A functional schematic of the proposed measurement circuit is shown in FIG. 1. With this scheme the use of series resistors and switches in the main H-Bridge is avoided, and thus the maximum power output (MPO) is not reduced.

FIG. 1 provides a high-level schematic diagram of a hearing device with an embodiment of a built-in automatic self-test mechanism according to the present invention. Ambient sound is picked up by a microphone 1 (acting as an input transducer), which outputs an audio signal that is processed by a signal processor 2. The signal processor 2 outputs a processed audio signal, which is applied to an audio amplifier 3. The audio amplifier 3 is typically implemented as a class D amplifier with an H-bridge. The amplified signal is provided to a receiver 4 (i.e. a miniature loudspeaker), which converts the amplified signal into sound that is delivered into the ear canal of the user of the hearing device.

In order to avoid the use of a resistor to determine the voltage and therewith the impedance in the audio path, thereby increasing the output impedance and impacting (i.e. reducing) the MPO during normal operation of the hearing device, the present invention proposes to provide a second, measurement bridge circuit 5 in parallel with the H-bridge of the class D audio amplifier 3, specifically for measuring the receiver's electrical and acoustical impedance. The measurement bridge circuit 5 is thus connected to the same two input ports of the receiver 4 as the H-bridge of the class D audio amplifier 3, and supplies an alternating current (AC) and/or direct current (DC) signal to the receiver 4, while measuring the voltage across the receiver 4. The DC current is provided by a first pair of current steering digital-to-analogue converters (DACs) 7. This first pair of current steering digital-to-analogue converters 7 is controlled by a first output A of the signal processor 2, in particular by an output of an audio delta-sigma converter, more particularly by a noise shaper output code of the audio delta-sigma converter. Likewise, the AC current is provided by a second pair of current steering digital-to-analogue converters (DACs) 7'. This second pair of current steering digital-to-analogue converters 7' is controlled by a second output B of the signal processor 2, in particular by the output of the audio delta-sigma converter, more particularly by another portion of the noise shaper output code of the audio delta-sigma converter.

When performing a receiver impedance measurement the hearing device is set to a measurement/self-test mode in which the audio amplifier 3 is disabled, in particular switched to a high impedance state, and the measurement bridge circuit 5 supplies a DC or an AC current to the receiver 4 and measures a voltage at the receiver 4, which is amplified by the measurement amplifier 6 to provide an measurement voltage signal, which is then fed to an input C of the signal processor 2. All voltage signals may be analog or digital signals. Conversion between the analog and digital domain may be realised within the signal processor 2 or by a separated analog-to-digital converter (not shown). Based on the measurement voltage signal the signal processor 2 can determine the presence of a fault condition, e.g. when the receiver 4 is not correctly connected to the hearing device, or when the connected receiver 4 is not of a certain, desired receiver type, or when the hearing device is not correctly placed within the ear canal of the user of the hearing device, or when the receiver 4 or sound outlet of the hearing device is obstructed, for instance clogged by cerumen/earwax. When the self-test/measurement has been completed the hearing device is switched back to a normal mode of operation where the audio amplifier 3 is enabled and provides an amplified output signal to the receiver 4.

In order to determine certain fault conditions reference data for the frequency-dependent impedance is required. This reference data in particular includes the resonance frequency of one or more peaks of the impedance of the receiver 4 as determined by measuring the impedance of the receiver 4 when the hearing device is being properly (e.g. sealingly) worn in the ear canal of the user as well as when the hearing device is not being worn. These one or more peaks are for instance determined during fitting of the hearing device to the needs and preferences of the user. This reference data is then stored in a non-volatile memory (e.g. EEPROM) of the hearing device.

If the hearing device determines that a fault condition is present it may provide an optical fault indication signal to the user, for instance by means of a light emitting diode (LED). Alternatively, it may provide an acoustic signal via the receiver to the user, in particular when no fault condition has been detected and the hearing device is ready for fitting. In this way the notification is a "hearing device working fine" confirmation. Otherwise, the acoustic confirmation would not be sent, because it would very likely not be heard by the user due to the fault condition, e.g. improper insertion, bad connection of the receiver, wrong receiver type or clogged receiver. Moreover, the hearing device may disable adjusting of one or more hearing device settings or disable at least one function of the hearing device when the presence of a fault condition has been detected.

In order to ensure reliable measurements the measurement bridge circuit 5 comprises a resistor R as a minimal load when no receiver 4 is connected to the hearing device or when the receiver 4 is incorrectly connected to the hearing device.

For AC impedance measurements to determine improper insertion of the receiver 4 into the ear canal or receiver contamination, the AC signal is generated by the signal processor 2 for instance with the aid of a sound generator capable of producing a frequency sweep or a polyphonic signal, e.g. in the form of a hearing device start-up melody ("jingle"). The latter has the advantage of not being regarded as an unpleasant disturbance by the user. A self-test/check could be done at each start-up of the hearing device. Likewise, also the DC impedance measurement, in particular to determine faulty receiver connectivity and an incorrect receiver type, could be done at each start-up of the hearing device. Moreover, the self-test could also be triggered each time a fitting session is started, e.g. while detecting the hearing device.

Figure 2:
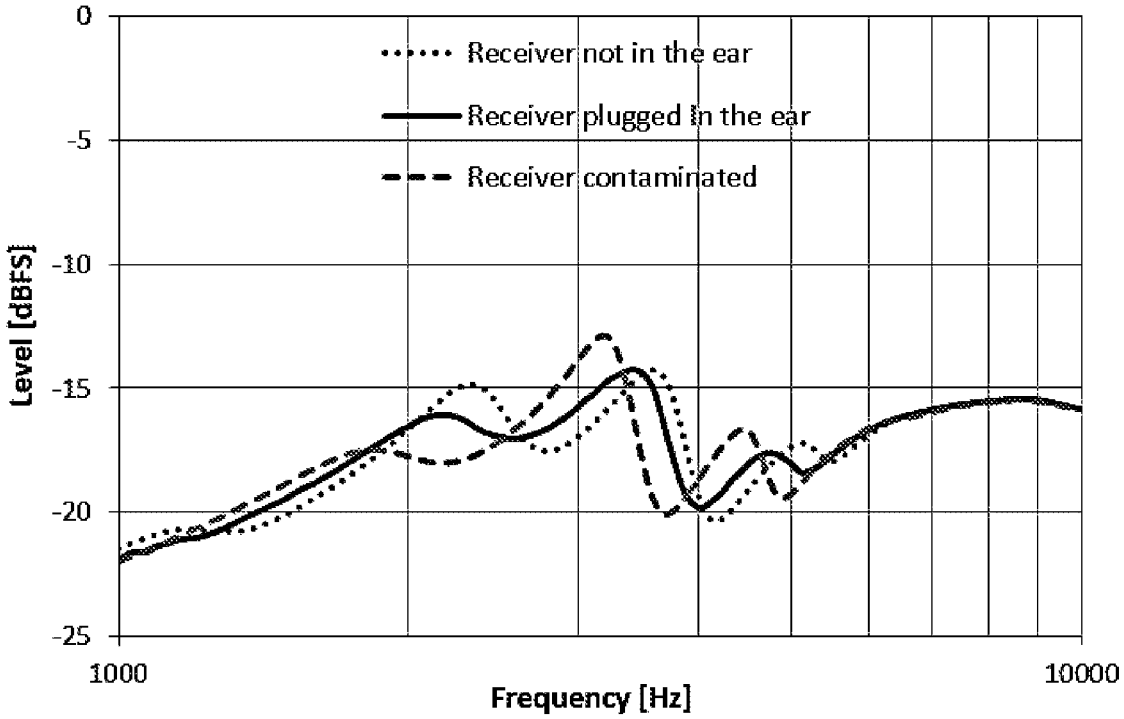
FIG. 2 an exemplary graph illustrating receiver impedance measurements made with a built-in automatic self-test mechanism according to the present invention.

FIG. 2 illustrates exemplary receiver impedance curves for the case when the receiver 4 is not located in the ear (cf. dotted line), when the receiver is correctly inserted into the user's ear canal (cf. solid line), and when the receiver is contaminated, e.g. clogged with earwax (cf. dashed line). As can be seen by comparing the plots for these three cases, the resonance peaks of the measured receiver impedance are located at different frequencies depending on the current situation. When the receiver 4 is being worn correctly in the ear canal the resonance peaks are located at lower frequencies than when the receiver 4 in not being worn. When the receiver is clogged the resonance peaks are located between those measured in the other two situations (i.e. receiver being correctly worn and not being worn).

The present invention proposes a self-test method that helps to check a hearing device's readiness for fitting and notify the fitter or user accordingly. Hearing device readiness in this context means that possible fault conditions such as improper insertion of the hearing device into the user's ear canal, wrong receiver type, bad receiver connection or receiver contamination by earwax have been checked and can be excluded. Otherwise, the fitting process is locked if the self-test is not successful in order to ensure that the hearing device is not incorrectly fitted.

The self-test according to the present invention is also important and convenient for remote support/fitting as well as self-fitting. In such cases the hearing care professional cannot (visually) check or inspect the hearing device prior to fitting.

LIST OF REFERENCE SYMBOLS

1 microphone, input transducer
2 signal processor
3 audio amplifier
4 receiver (miniature loudspeaker)
5 measurement bridge circuit
6 measurement signal amplifier
7,7' (first & second pair of) current sources
A DC control signal (from signal processor)
B AC control signal (from signal processor)
C amplified measurement (voltage) signal
GND ground
R load resistor
$V_{bat}$ battery voltage

What is claimed is:

1. A hearing device, comprising:
an input transducer (1);
a signal processor (2);
an amplifier (3), in particular a class D amplifier with an H-bridge;
a receiver (4),
a measurement bridge circuit (5) connected to the receiver (4) in parallel with the amplifier (3),
wherein the input transducer (1) is connected to the signal processor (2), the signal processor (2) is connected to the amplifier (3), and the amplifier (3) is connected to the receiver (4),
wherein a direct current or an alternating current is provided by a respective current steering digital-to-analogue converter (7, 7'),
wherein the measurement bridge circuit (5) is adapted to controllably supply the direct current or the alternating current to the receiver (4) and to measure a voltage at the receiver (4),
wherein the hearing device is operable in a normal mode and in a measurement mode,
wherein in the normal mode the amplifier (3) is enabled and provides an amplified output signal to the receiver (4),
wherein in the measurement mode the amplifier (3) is connected to the receiver and is disabled, and the measurement bridge circuit (5) supplies the direct current and/or alternating current to the receiver (4) and measures the voltage at the receiver (4),
wherein the current steering digital-to-analogue converter comprises a current source.

2. The hearing device of claim 1, wherein the measurement bridge circuit (5), is controllable by an output (A, B) of the signal processor (2).

3. The hearing device of claim 1, wherein a first current steering digital-to-analogue converter (7) is controlled by a first output (A) of the signal processor (2), and wherein a second current steering digital-to-analogue converter (7') is controlled by a second output (B) of the signal processor (2).

4. The hearing device of claim 1, wherein the hearing device further comprises a non-volatile memory storing reference data pertaining to one or more amplitude and frequency peaks of an impedance of the receiver (4), and wherein the one or more peaks are determined by measuring the impedance of the receiver (4) when the hearing device is being sealingly worn in an ear canal of the user and/or when the hearing device is not being worn.

5. The hearing device of claim 4, wherein the hearing device is adapted to detect a presence or absence of a fault condition based at least partly on the reference data.

6. The hearing device of claim 4, wherein the hearing device is adapted to detect a presence or absence of a fault condition based at least partly on a comparison of a quantity related to the measured voltage at the receiver (4) with at least part of the reference data.

7. The hearing device of claim 1, wherein the hearing device is adapted to detect a presence or absence of a fault condition based on one or more of the following:

a direct current impedance of the receiver (4), determined by applying the direct current to the receiver (4), as an indication whether the receiver (4) is correctly connected to the hearing device and as an indication whether a certain, desired receiver type is connected to the hearing device, the latter being dependent on a comparison of a quantity related to the measured voltage at the receiver (4) with a predetermined reference value or range representative for the certain, desired receiver type;

an alternating current impedance of the receiver (4), determined by applying the alternating current to the receiver (4), as an indication whether the receiver (4) is not obstructed, being dependent on a comparison of a quantity related to the measured voltage at the receiver (4) with one or more predetermined reference values representative for the receiver (4) not being obstructed.

8. The hearing device of claim 1, wherein the hearing device is adapted to perform at least one of the following based on a presence or absence of a fault condition:

provide an optical fault indication signal;

provide an acoustic signal via the receiver;

disable adjusting of one or more hearing device settings when the presence of a fault condition has been detected;

disable at least one function of the hearing device when the presence of a fault condition has been detected.

9. The hearing device of claim 1, wherein the measurement bridge circuit (5) comprises a resistor (R) as a minimal load when no receiver (4) is connected to the hearing device or when the receiver (4) is incorrectly connected to the hearing device.

10. A method for testing the hearing device of claim 1, based on employing the measurement bridge circuit (5) connected to the receiver (4) of the hearing device in parallel with the amplifier (3) of the hearing device, wherein the amplifier (3) is a class D amplifier with an H-bridge, the method comprising the steps of:

disabling the amplifier (3) to change operation of the hearing device from the normal mode, in which amplifier (3) is enabled and provides the amplified output signal to the receiver (4), to the measurement mode;

providing the direct current or the alternating current via the respective current steering digital-to-analogue converter (7, 7');

applying with the measurement bridge circuit (5) the direct current and/or the alternating current to the receiver (4);

measuring with the measurement bridge circuit (5) the voltage at the receiver (4);

detecting a presence or absence of a fault condition based on the measured voltage.

11. The method of claim 10, further comprising at least one of the following based upon detecting the presence or absence of a fault condition:

providing an optical fault indication signal;

providing an acoustic signal via the receiver;

disabling adjusting of one or more hearing device settings when the presence of a fault condition has been detected;

disabling at least one function of the hearing device when the presence of a fault condition has been detected.

12. The method of claim 10, wherein a frequency of the alternating current applied to the receiver (4) is varied to provide a frequency sweep or a polyphonic signal to the receiver (4) as a test signal.

13. The method of claim 10, wherein detecting the presence or absence of a fault condition is based on determining an impedance of the receiver (4) as a function of a frequency of the alternating current applied to the receiver (4) and comparing the determined impedance with pre-determined reference data.

14. The method of claim 10, wherein the method is started upon each powering-on of the hearing device.

15. The method of claim 10, wherein the method is started when initiating fitting of the hearing device to needs and preferences of a user when initiating a self-fitting session or a remote fitting session.

16. The method of claim 10, wherein the method is started when initiating a remote support session.

17. The method of claim 10, wherein the method is started by a user by operating a control element at the hearing device or at a hearing device accessory.

18. The hearing device of claim 1, wherein the respective current steering digital-to-analogue converter (7, 7') is controllable by an output (A, B) of signal processor (2).

19. The hearing device of claim 1, wherein the respective current steering digital-to-analogue converter (7, 7') is controllable by an output of an audio delta-sigma converter.

20. The hearing device of claim 1, wherein the amplifier is disabled by reducing a supply current to the amplifier.

21. The hearing device of claim 1, wherein the measurement bridge circuit is connected to the receiver by a first input port and a second input port, and the H-bridge is connected to the receiver by the first input port and the second input port.

* * * * *